US006071622A

United States Patent [19]

Beesabathina et al.

[11] Patent Number: 6,071,622

[45] Date of Patent: Jun. 6, 2000

[54] STABILIZED TWO-PHASE-GLASS DIFFUSION BARRIER

[76] Inventors: Durga Prasad Beesabathina; Prasad Rao Kalvala; Karl Erik Wiedemann, all of 107 Research Dr., Hampton, Va. 23666-1340

[21] Appl. No.: 09/183,181

[22] Filed: Oct. 30, 1998

[51] Int. Cl.[7] ..... B32B 9/00

[52] U.S. Cl. ..... 428/427; 428/428; 428/426; 428/432; 428/469; 428/702; 428/920

[58] Field of Search ..... 428/426–428, 428/432, 469, 701, 702, 920, 472.2; 501/12, 63; 416/241 R, 241 B

[56] References Cited

U.S. PATENT DOCUMENTS

| | | | |
|---|---|---|---|
| 3,102,044 | 8/1963 | Joseph | 117/22 |
| 3,248,251 | 8/1963 | Allen | 106/286 |
| 3,257,230 | 6/1966 | Watchell et al. | 117/107.2 |
| 3,544,348 | 12/1970 | Boone et al. | 117/2 |
| 3,767,434 | 10/1973 | Thomas | 106/52 |
| 3,819,338 | 6/1974 | Bungardt et al. | 29/194 |
| 4,337,295 | 6/1982 | Rittler | 428/410 |
| 4,358,541 | 11/1982 | Andrus et al. | 501/5 |
| 4,526,814 | 7/1985 | Shankar et al. | 427/253 |
| 4,933,307 | 6/1990 | Marshall et al. | 501/39 |
| 5,057,196 | 10/1991 | Creech et al. | 204/181.5 |
| 5,153,070 | 10/1992 | Andrus et al. | 428/408 |
| 5,173,454 | 12/1992 | Rittler | 501/5 |
| 5,298,332 | 3/1994 | Andrus et al. | 428/469 |
| 5,660,885 | 8/1997 | Haz et al. | 427/374.5 |
| 5,763,107 | 6/1998 | Rickerby et al. | 428/623 |
| 5,773,141 | 6/1998 | Hasz et al. | 428/335 |

*Primary Examiner*—Timothy M. Speer
*Assistant Examiner*—Bryant Young

[57] ABSTRACT

An article with a corrosion-resistant diffusion barrier is provided to resist the attack of corrosion agents, during service at high temperature (>600° C.). More specifically, a diffusion barrier containing a stabilized two-phase glass is provided. The stabilized two-phase glass comprises glass-forming oxides, other oxides with low cation coordination numbers and stabilizing agents wherein the glass-forming oxides block ionic transport by virtue of their network formation on the atomic scale and the stabilizing agents improve the stability of the diffusion barrier and compatibility with the substrate. The diffusion barrier covers some portion of the substrate that is optionally augmented by a base layer or a sealant layer. Being impervious and having low-solubility in corrosive environments, the diffusion barrier stops corrosive agents from reaching the substrate. When applied over aluminide coatings, it effectively improves the potency of the aluminides and prevents their rapid dissolution into the corrosive environment. The diffusion barrier can be applied by a process that evenly coats intricate geometries and does not harm substrate properties.

6 Claims, 6 Drawing Sheets

STABILIZED TWO-PHASE-GLASS DIFFUSION BARRIER

BACKGROUND-FIELD OF THE INVENTION

This invention relates to a high-temperature oxidation and corrosion-resistant coated article and more specifically it relates to a stabilized two-phase-glass diffusion barrier for coating substrates that will be subjected to corrosive environments at high temperatures whereby the life and performance of the coated article is improved.

BACKGROUND-DISCUSSION OF PRIOR ART

Among the materials used at high temperatures in corrosive environments, superalloys are among the most important. The need for developing protective coatings for superalloys stems from the incompatibility of compositional requirements for their improved high-temperature mechanical strength and enhanced hot-corrosion resistance. For example, the high-temperature strength of nickel-based superalloys was increased by decreasing chromium content, which in turn decreased their hot-corrosion resistance. Refractory elements such as molybdenum, tungsten and vanadium, which were added to enhance the high-temperature strength of nickel-based alloys, were detrimental to their hot-corrosion resistance. The level of aluminum added to superalloys was insufficient to provide long-term oxidation protection. This necessitated application of protective surface coatings on currently used high-temperature components made of superalloys.

Of the many coating application methods, the most popularly used is the pack cementation method where aluminum is diffused into the surface of superalloys. Watchtell et al, U.S. Pat. No. 3,257,230, and Boone et al, U.S. Pat. No. 3,544,348 were among those who have described this method. A variation of this method, known as slurry aluminizing, was described by Joseph et al, U.S. Pat. No. 3,102,044, and Allen, U.S. Pat. No. 3,248,251. After alloying, aluminum forms stable intermetallic compounds such as the nickel-aluminide phase for nickel-based superalloy substrates. The aluminum concentration in these intermetallic compounds was sufficiently high for protective continuous external oxides to form at high temperatures. This alumina layer was tightly adherent and tough compared to the loosely adherent base metal oxide.

Although aluminide-based coatings increased resistance to oxidation, their effectiveness was limited because they were not resistant to hot corrosion under sulfidizing conditions. Being reactive with acidic and basic species of molten salts, the coatings based on alumina dissolved at high temperatures leaving the substrate open to attack. This led inventors to attempt to modify the chemistry of conventional nickel aluminide coatings with elements such as chromium, silicon or platinum.

Chromium was one of the first elements used to modify aluminide coatings. A moderate increase in resistance to hot corrosion at intermediate temperatures (815° C.–925° C.) was achieved by increasing the chromium concentration of the aluminide coating over that normally desired in the superalloy substrate [R. S. Bartocci, ASTM STP 421, p.169 1967; S. J. Griasaffe in "The Superalloys", Ed. C. T. Tims, W. C. Hagel, John and Wiley and Sons, N.Y. 342 (1972); A. J. Mom, High-temperature Coatings for Gas Turbines, an Overview, NLR MP 81003U, Netherlands (1981); P. Galmische, Met. and Mater., 2, 8, 241 (1968)]. This has been accomplished by a chromizing process, a pack cementation process, or as electrophoretic process [K. H. Ryan, J. O. Hodshire and Q. O. Shockley in Proceedings of the 1974 Gas Materials in the Marine environment Conference, P. 237, Ed. J. W. Fairbanks, I. Machlin, MCIC-75-27], among others. The protective mechanism of chromium diffusion coatings was derived from their ability to develop a dense, coherent oxide $Cr_2O_3$, as a diffusion barrier against further oxidation, sulfidization or hot corrosion. Though useful for corrosion protection at temperatures up to about 850° C.–950° C., these coatings alloyed with chromium had the problem that, when the coated article was subjected to higher temperatures (> about 950° C.), $Cr_2O_3$ failed to provide high-temperature oxidation resistance as it was unstable at temperatures above 950° C. and volatilized.

Attention was also given to the alloying of aluminide coatings with silicon. Deadmore et al, U.S. Pat. No. 4,310,574, described a method of incorporating silicon into the surface of an alloy during aluminization. The protective effect of this type of coating was due to the formation of a silica layer over $Ni_2SiO_4$ scale. Although siliconized nickel-based materials exhibited excellent oxidation and hot-corrosion resistance, siliconized coatings were very brittle and susceptible to cracking and thermal fatigue failure. Also, in silicon diffusion coatings on nickel-based superalloys, NiSi formed by the coating process was unstable and formed a eutectic with $Ni_2Si$ or $NiSi_2$ (melting point 965° C.) making it inappropriate for high-temperature applications and sometimes embrittling the coated parts.

Improvement in the properties of diffusion aluminides was achieved by incorporating noble metals such as platinum, rhodium etc. The concept of the platinum aluminide coating was first developed by Lehnert with the original British patent issued in 1970 [G. Lehnert, British Patent, 1210026, 1970]. The coating was produced by initially electrodepositing a platinum layer onto a nickel base alloy and subsequently aluminizing the platinized component. Bungardt et al, U.S. Pat. Nos. 3,677,789 and 3,819,338 showed that hot-corrosion and oxidation resistance of diffused aluminides may be enhanced by incorporating metals of the platinum group. Though platinum was found to significantly inhibit the basic fluxing mechanism of high-temperature hot corrosion, it offered little improvement in suppressing the gas-phase-induced acidic fluxing of low-temperature hot-corrosion [American Society of Mechanical Engineers, Paper 85-GT-60, Low-Temperature Hot corrosion in Gas Turbines: A Review of Causes and Coatings, by G. W. Goward, p.3, 1985].

Attempts were also made to modify aluminide coatings using more than one modifier resulting in duplex (platinum-chromium or platinum-silicon) or triplex (platinum-chromium-silicon) coatings. Shankar et al, U.S. Pat. No. 4,526,814 described protective aluminides formed by diffusing chromium and platinum into nickel before aluminizing. Creech et al, U.S. Pat. No. 5,057,196 described the method for diffusing platinum and silicon into the nickel substrate and then diffusing aluminum-chromium through it. McMordie et al, U.S. Pat. No. 5,650,235 described the method of making a platinum enriched, silicon-modified diffusion aluminide coating.

Although these modified-aluminide coatings exhibited better oxidation and hot-corrosion resistance than conventional aluminides, being intermetallic, they exhibited a reduction in coating ductility and an undesirable increase in the ductile-to-brittle-transition temperature. The inward-grown platinum aluminides consisted of hard and brittle duplex phases and suffered from thermal and mechanical-fatigue failure. Being brittle, they were prone to cracking, which led to reduced coating reliability. Being thick (75–100 $\mu$m), they were susceptible to spalling due to thermal shock.

Because of interdiffusion, the modified-aluminide coatings altered the composition of the substrate material and led to the formation of deleterious phases. As a result, creep and ductility properties were reduced. The brittle intermetallic coatings developed fine cracks that propagated into substrate by fatigue and reduced life time. Further, these modified coatings were applied using expensive materials and by complicated and costly processing steps.

In view of the above limitations of aluminide coatings, attempts were made to develop alternative coatings such as glass-ceramic coatings and glass coatings. Raymund et al, U.S. Pat. No. 5,741,596, described a method for applying a three-layer glass-ceramic coating over an aluminide coating. It consisted of barium alumino-silicate, alumina and high silica. Ronald et al, U.S. Pat. Nos. 5,298,332, 5,153,070, and 4,358,541, and MacDowell et al, U.S. Pat. No. 4,861,734, also described methods for preparing and applying glass-ceramic coatings on alloys for high-temperature applications. But the prior art failed to recognize the importance of mechanical integrity of the coatings to the substrates. Being thick (about 15 $\mu$m), they lacked toughness and tended to spall from the substrate. Further, these coatings were very expensive involving elaborate and expensive methods of manufacture. For example, different oxides were ball-milled, mixed and melted at very high-temperature (1600° C.) and for long times (100 hours). The glass was ground into fine powder, electrosprayed on to an aluminide coating and cured at high-temperatures (800–1000° C.).

To reduce the cost, and improve the oxidation resistance of high-temperature materials, attempts have been made to apply glass coatings to metallic substrates. Deyrup et al, U.S. Pat. No. 2,467,114, described the method for applying vitreous coatings. But they were not suitable for thin-layer deposition. These coatings melted at relatively lower temperatures making them unsuitable for high-temperature applications and failed to protect materials from oxidation and hot-corrosion. The glass coating that was described by Wiedemann et al, (U.S. Patent pending with Ser. No. 07/912,960) was based on a three layer coating for oxidation resistance of titanium. It consisted of an inner reactive barrier, an intermediate diffusion layer, and a top sealant glass layer. Though they were deposited by a simple deposition process, these coatings were not compatible with nickel-based alloys as they reacted with them. Further, they failed to adhere well with the substrate material and spalled-off quickly. M. J. Bennett et al ["New Coatings for High-temperature Materials Protection", M. J. Bennett, J. of Vac. Sci. Tech., B2(4), October–December 1984, p.800–805] studied oxidation resistance of ceria based sol-gel coating deposited on 20% Cr–25% Ni—Nb stabilized stainless steel. The coating was not an efficient oxygen barrier and was thick (~20 $\mu$m) making it susceptible to spalling.

To summarize, all oxidation and hot-corrosion-resistant coatings for high-temperature applications known heretofore suffered from a number of disadvantages:

1. They provided inconsistent oxidation resistance because of volatilization of protective oxides and loss of protective elements.
2. They were not resistant to hot-corrosion because of their reactivity with acidic and basic species of molten salts.
3. They deteriorated substrate properties, and reduced its life because they reacted with the substrate and formed brittle phases and low-melting eutectics.
4. They exhibited metastability leading to inconsistency in mechanical properties.
5. They spalled due to volume change associated with phase transformations.
6. They exhibited poor resistance to cracking due to brittleness of intermetallic phases.
7. They exhibited poor thermal-shock and thermal-fatigue resistance due to excessive coating thickness and brittleness of intermetallic phases.
8. They were not chemically compatible with the substrate material and did not adhere well to the substrates.
9. Their properties were difficult to optimize due to a lack of flexibility in the compositions of the coatings formed.
10. They incurred high cost because of the use of expensive materials and complicated and elaborate processing steps.

OBJECTS AND ADVANTAGES

Accordingly, several objects and advantages of this invention are to provide a diffusion barrier that 1. Will provide consistent oxidation resistance because of non-volatile protective oxides and protective elements.
2. Will be resistant to hot corrosion because of non-reactivity with acidic and basic species of molten salts.
3. Is non-reactive with the substrate material and therefore will not adversely affect mechanical properties or reduce lifetime and will not form brittle phases or low-melting eutectics.
4. Is stable resulting in consistent mechanical properties.
5. Will not spall because it is not subjected to phase transformations or associated volume changes.
6. Is ductile and self-healing in the event of cracking because of its two-phase glassy structure.
7. Is thin and therefore exhibits substantial thermal-shock and thermal-fatigue resistance.
8. Is chemically compatible with the substrate material and adheres well to the substrates.
9. Will use a process that is easy to optimize due to its flexibility in the composition of the coatings formed.
10. Will cost less because of the use of inexpensive materials and simple processing steps.

Further, an object of this invention is to use a process for applying the coating that avoids the need for the expensive equipment used in applying prior-art coatings, easily coats intricate geometries and hidden surfaces, makes it easy to repair the failed components, makes it easy to optimize properties due to compositional flexibility and does not necessarily use materials that are extremely hazardous to man and the environment.

Further objects and advantages will become apparent from a consideration of the ensuing description and accompanying drawings.

REFERENCE NUMERALS IN DRAWINGS

Figure 1:
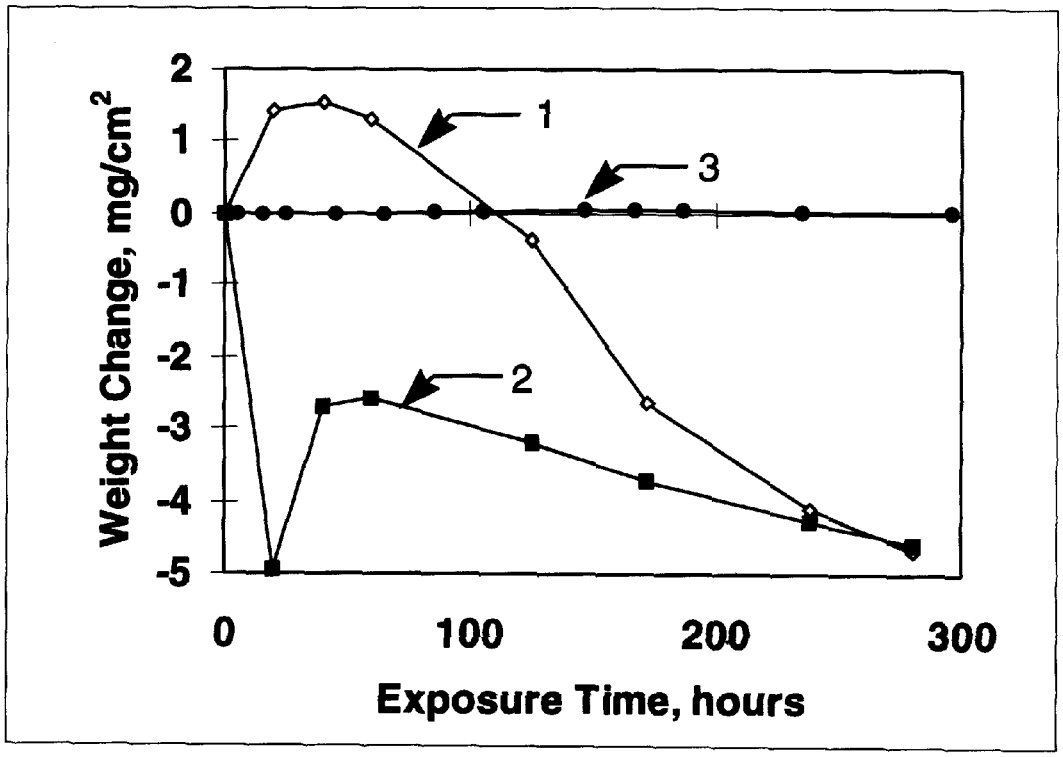
FIG. 1 shows the relative oxidation resistance of a nickel-based superalloy (IN 738 LC) articles at 1000° C., before coating, after applying a comparable prior-art two-phase-glass diffusion-barrier coating, after applying a stabilized two-phase-glass diffusion-barrier coating according to this invention and after applying an La-stabilized two-phase-glass diffusion-barrier coating according to this invention.

1. Weight change of IN 738 LC before coating.
2. Weight change of IN 738 LC after applying a prior-art two-phase-glass diffusion barrier coating.
3. Weight change of IN 738 LC after applying an La-stabilized-two-phase-glass diffusion barrier of this invention.
4. Weight change of IN 738 LC after applying a prior-art PtAl coating.
5. Weight change of IN 738 LC after applying a prior-art NiAl coating.
6. Weight change of IN 738 LC after applying a stabilized-two-phase-glass diffusion barrier of this invention.
7. Weight change of IN 738 LC after applying a stabilized-two-phase-glass diffusion barrier of this invention over a prior-art PtAl coating.
8. Weight change of IN 738 LC after applying stabilized-two-phase-glass diffusion barrier of this invention over a prior-art NiAl coating.
9. Weight change of CMSX-4 before coating.
10. Weight change of CMSX-4 after applying a prior-art PtAl coating.
11. Weight change of CMSX-4 after applying a prior-art NiAl coating.
12. Weight change of CMSX-4 after applying an alumina base layer and an La-stabilized-two-phase-glass diffusion barrier of this invention.
13. Weight change of CMSX-4 after applying an alumina base layer and an La-stabilized-two-phase-glass diffusion barrier of this invention over a prior-art PtAl coating.
14. Weight change of CMSX-4 after applying an alumina base layer and an La-stabilized-two-phase-glass diffusion barrier of this invention over a prior-art NiAl coating.
15. Weight change of IN 738 LC after applying a borosilicate base layer and an La-stabilized-two-phase-glass diffusion barrier of this invention.
16. Weight change of IN 738 LC after applying a borosilicate base layer and an La-stabilized-two-phase-glass diffusion barrier of this invention over a prior-art PtAl coating.
17. Weight change of IN 738 LC after applying a borosilicate base layer and an La-stabilized-two-phase-glass diffusion barrier of this invention over a prior-art NiAl coating.
18. Weight change of CMSX-4 after applying an alumina base layer, a borosilicate base layer and an La-stabilized-two-phase-glass diffusion barrier of this invention.
19. Weight change of CMSX-4 after applying an alumina base layer, a borosilicate base layer and an La-stabilized-two-phase-glass diffusion barrier of this invention over a prior-art PtAl coating.
20. Weight change of CMSX-4 after applying an alumina base layer, a borosilicate base layer and an La-stabilized-two-phase-glass diffusion barrier of this invention over a prior-art NiAl coating.

SUMMARY OF THE INVENTION

The present invention, in one form provides a coated article comprising in its most reduced form a substrate and a diffusion barrier containing a stabilized two-phase glass. The substrate is a material facing corrosive species, for example oxygen, chlorides or sulfur compounds, during service at high temperatures (>600° C.) which can fail to perform its intended function because of corrosive attack. The stabilized two-phase glass comprises glass-forming oxides, other oxides of low cation coordination number and stabilizing agents wherein the glass-forming oxides block ionic transport by virtue of their network formation on the atomic scale and the stabilizing agents improve the compatibility between the substrate and the diffusion barrier and hence the durability of the diffusion barrier. The diffusion barrier, being impervious and resisting dissolution into the corrosion environment stops corrosive agents from reaching the substrate.

Another form of the present invention is a method of protecting turbine blades. Such a method comprises using a diffusion barrier containing a stabilized two-phase glass to shield portions of turbine blades from corrosive environments. The diffusion barrier, being impervious and resistant by itself to corrosion attack, stops corrosive agents from reaching the surface of the turbine blades and thus protects them. In a related form, the diffusion barrier effectively improves the potency of aluminide coatings applied on turbine blades by reducing aluminum depletion and thereby reducing aluminum consumption; by reducing oxygen influx which lowers the critical aluminum concentration; and by shielding aluminide coatings from molten salts and thus preventing their rapid dissolution into the corrosive environment.

Another form of the present invention is a coating process wherein the diffusion barrier is applied to a substrate.

Another form of the invention is a method for applying oxide layers by a sol-gel process wherein a coating can be applied without deteriorating the properties of the substrate. Precursors to the oxides are applied as sols. When the applied sol dries, it forms an amorphous film, which is referred as a gel. When the gelled film is cured, the final oxide is formed. The gel to final oxide conversion can be done at room temperature under some circumstances or at elevated temperatures to speed up the process.

Another form of this invention is the stabilized two-phase-glass diffusion-barrier material that contains a plurality of glass forming oxides and a stabilizing agent. The glass-forming oxides block ionic transport by virtue of their three-dimensional network formation on the atomic scale. The material resists corrosive attack, because of the low solubility of its major constituents in typical molten-salt corrosive deposits. It does not allow the corrosive agents to reach the substrate because it is impervious. The stabilizing agents facilitate effective operation of substrate and diffusion barrier by improving chemical stability with the substrate. The stabilizing agents, having an affinity for the more volatile constituents of the diffusion barrier, improve the stability of the diffusion barrier at high-temperatures. The two-phase-glassy structure resists cracking by a self-healing mechanism. The majority phase in the diffusion barrier has a higher softening point than the other phases and at a temperature between the lower and higher softening point, the glass will act as both a sealant and a barrier because the minority phase can flow to fill gaps and repair cracks while the majority phase remains rigid.

DESCRIPTION OF THE INVENTION

1. Coated Article

A coated article according to this invention comprises:

a) a superalloy substrate b) optionally, a base layer c) a diffusion barrier containing a stabilized two-phase glass that comprises:

i) a stabilized two-phase-glass diffusion-barrier material and ii) optionally, a sealant material The substrate is an underlying substance. Covering some portion of the substrate, optionally there is a base layer that when present prevents direct contact of the diffusion barrier and the substrate. Covering the base layer or some portion of the substrate if no base layer is present, there is a diffusion barrier containing a stabilized two-phase glass. The diffusion barrier has one or more layers where the first or innermost is a layer of stabilized two-phase-glass diffusion-barrier material. Covering the first layer, optionally is a layer of sealant material that improves the impermeability of the layer of barrier material by filling any cracks, gaps or pores. If there is a layer of sealant material, it in turn may be covered by a layer of barrier material to prevent direct exposure of the sealant material in that layer to the corrosive environment. The layers of barrier material and sealant material may be repeated any desired number of times with the final layer being either barrier material or sealant material.

2. Method for Protecting Turbine Blades

A method of protecting turbine blades according to this invention comprises:

a) optionally, applying an aluminide coating such as a platinum or nickel aluminide and oxidizing the aluminide coating briefly to produce a thin alumina layer b) optionally, using a base layer to separate the diffusion barrier from the substrate or aluminide coating c) applying a diffusion barrier containing a stabilized two-phase glass d) optionally, applying a thermal barrier coating.

3. Coating Process

A coating process comprising:

a) optionally, applying a base layer over some portion of the substrate b) applying a diffusion barrier containing a stabilized two-phase glass over the base layer or over some portion of the substrate if no base layer is present comprising:

i) applying a layer of stabilized two-phase-glass diffusion-barrier material ii) optionally, applying a layer of sealant material on top of the layer of stabilized two-phase-glass diffusion-barrier material, and iii) optionally, applying additional alternating layers of barrier material and sealant material if a layer of sealant material has been applied.

The application of layers of barrier material and sealant material may be repeated any desired number of times with the final or outermost layer being either barrier material or sealant material.

4. Method of Applying Oxide Layers by Sol-gel

A method of applying the oxide layers by sol-gel comprises:

a) preparing a sol b) a coating cycle comprising:

i) applying the sol ii) gelling of the applied sol and iii) curing of the gelled sol.

The full thickness of a layer may be developed in a single coating cycle or the cycle may need to be repeated a number of times. A sol is a colloidal suspension of solid particles in a liquid wherein the solid phase contains no dense oxide particles larger than 300 nm. A gel is a solid that forms when the sol is dried. It is cured to get an oxide.

5. Coating Materials

5a) A base layer according to this invention is any layer that enhances the compatibility of the substrate and the stabilized two-phase-glass diffusion barrier and that is stable in contact with the substrate and the stabilized two-phase-glass diffusion barrier at high temperatures and prevents direct contact between the substrate and the stabilized two-phase-glass diffusion barrier.

5b) A stabilized two-phase-glass diffusion-barrier material according to this invention comprises:

a) more than one glass-forming oxide inducing a tendency to form two or more glassy phases b) optionally, other oxides with low cation coordination numbers and c) a stabilizing agent that improves compatibility with the substrate material.

The glass-forming oxides form a three-dimensional network on the atomic scale by virtue of their high field strengths, low coordination numbers, and high valence numbers. The field strengths of the glass-forming oxides should be greater than 1.3 (valence number divided by the square of the ionic distance in angstroms). The coordination numbers of the cations of the glass-forming oxides should be 3 or 4. The valence numbers of the cations of the glass-forming oxides should be 3 to 5. For the purpose of this invention, we call the diffusion barrier a stabilized two-phase-glass when it contains a stabilizing agent and at least two of the glass-forming oxides have field strengths that differ by more than 0.25. The only combinations of glass-forming oxides that satisfy the field strength requirement are those which have phosphorous oxide ($P_2O_5$) and at least one of the group boron oxide ($B_2O_3$), silicon oxide ($SiO_2$), and germanium oxide ($GeO_2$). The other oxides contained in the glass that are not glass-forming oxides or stabilizing agents should have cation coordination numbers of 3 or 4 so that they can be easily incorporated into the network provided by the glass-forming oxides. The stabilizing agent is an oxide or combination of oxides with a cation coordination numbers of 5 or greater. The stabilizing agent improves compatibility with the substrate, by reducing reactivity, by promoting adhesion or by reducing volatility such that the effectiveness of the diffusion barrier and length of time that the diffusion barrier remains effective improves.

5c) The sealant material according to this invention is a two-phase-glass layer that contains more than one glass-forming oxide inducing a tendency to form two or more glassy phases where the majority phase softens below the expected use temperature.

OPERATION OF THE INVENTION

1. Operation of the Coated Article

The diffusion barrier containing a stabilized two-phase glass forms an impervious and stabilized coating. Being impervious, the diffusion barrier stops corrosive agents at its outer surface and thereby stops them from reaching the substrate. The diffusion barrier by itself is resistant to the corrosive agents by virtue of the low solubility of its major constituents in the corrosive environment and thus remains an effective and reliable barrier for the substrate. The term stable has been used herein to indicate that the coating is compatible with the substrate, adherent to the substrate and non-volatile. Being compatible, the diffusion barrier forms a chemically stable system with the substrate so that both can operate effectively. The diffusion barrier, being adherent and non-volatile, promotes the long-term protection of the substrate. The base layer, when present, prevents direct contact between the diffusion barrier and the substrate thereby minimizing reactions between the substrate and the diffusion barrier and promoting adhesion. The sealant material contained in the diffusion barrier improves the impermeability of the barrier material by flowing to fill cracks, pores or other flaws in the diffusion barrier.

2. Operation of the Method of Protecting Turbine Blades

The diffusion barrier containing a stabilized two-phase glass covers some portion of the surface of the turbine blades. Optionally, there is a base layer on top of the turbine blades separating the diffusion barrier and the substrate. The diffusion barrier by itself resists the attack of corrosive agents and being impervious, stops corrosive agents from reaching the surface of the turbine blades. Consequently, the diffusion barrier protects the turbine blades. Further, it increases the potency of other coatings. For example, it could be used to cover aluminide coatings to increase their potency by reducing aluminum depletion thereby reducing consumption of aluminum; by reducing oxygen influx, lowering the critical aluminum concentration; by shielding against molten salts, preventing rapid dissolution of the aluminide coatings into the corrosive environment. Thus, the diffusion barrier effectively improves corrosion resistance of turbine blades when used alone or with other coatings.

3. Operation of the Coating Process

To some portion of a substrate a base layer, optionally, and a diffusion barrier containing a stabilized two-phase glass are applied. The base layer, when applied, would be applied first so that it separates the diffusion barrier from the substrate preventing direct contact and thereby promoting adhesion and minimizing adverse reactions. Then, over the base layer, the diffusion barrier would be applied. The diffusion barrier is applied by first applying a layer of barrier material and then optionally applying a layer of sealant material that improves the impermeability of the barrier material by filling cracks, gaps and pores. The application of layers of barrier and sealant can be repeated any number of times to build an alternating structure of barrier material and sealant material with the final or outermost layer being either barrier material or sealant material.

4. Operation of the Method of Applying Oxide Layers by a Sol-gel Process

A number of methods can be used to apply the diffusion barrier and the other layers to the substrate but the sol-gel process has the advantage of applying coatings without deteriorating the properties of the substrate. Because the oxide precursors are suspended in a liquid, it is easy to apply them as a coating. In addition, the sol chemistry can easily be modified to suit particular requirements. When the applied sol dries, it forms a predominantly amorphous film. This form is referred as a gel. It must then be cured to convert this film to the final oxide. It is possible to convert the gel to final oxide at room temperature under some circumstances. However, elevated temperatures help speed the conversion process.

5. Operation of the Coating Materials

The diffusion barrier contains glass-forming oxides and stabilizing agents. The glass forming oxides block oxygen transport by virtue of their three-dimensional network formation on the atomic scale. The diffusion barrier resists corrosive attack because of the low solubility of its major constituents in the corrosive environment. It does not allow the corrosive agents to reach the substrate because it is impervious. The stabilizing agents facilitate effective operation of substrate and diffusion barrier by promoting chemical stability with the substrate. The stabilizing agents, having an affinity for the more volatile constituents of the diffusion barrier improve the stability of the diffusion barrier at high-temperatures. The two-phase-glassy structure has good thermal cycling durability because of a self-healing mechanism that helps eliminate cracks. Because there are two or more glassy phases, each phase will soften at a different temperature so that there is not one softening point but many. The composition of the diffusion barrier is chosen so that the majority phase has the highest softening point. At temperatures between the lowest and highest softening point, the glass will act as both a sealant and a barrier because a minority phase can flow to fill gaps and repair cracks while the majority phase remains rigid. The diffusion barrier, when used to cover aluminide coatings, enhances their performance by blocking oxygen diffusion thereby increasing their potency and extending their useful life. The base layer, applied optionally, enhances the performance of the diffusion barrier by preventing direct contact between the diffusion barrier and the substrate and increasing the compatibility between them. The sealant layer, applied optionally, improves the impermeability of the diffusion layer by flowing and filling cracks, pores and other flaws.

EXAMPLES a) Preparing Sols a.1) Base Layer Sols a.1.1) An oxidation-resistance-enhancing base sol: Although any sol resulting in an oxide that enhances the oxidation resistance of the stabilized coatings can be applied, according to this example apply a sol that will result in alumina. Though the amounts of various ingredients of the sol can vary over a wider range, according to this example, mix them by weight in the following order and amount: Mix thoroughly 8.71 parts of isopropyl alcohol [2-PrOH ($C_3H_7OH$)], 0.58 parts of concentrated $HNO_3$, and 18.52 parts of Aluminum sec-butoxide. $HNO_3$ is needed to peptize the hydroxide to a clear sol. Add this mixture to 72 parts of DI water maintained at 90° C. For homogenization and polymerization, mix the solution thoroughly. Though there is no time limit for mixing, according to this example, mix the various ingredients of the solution for seventy-two hours. A clear and transparent water-like liquid is formed.

a.1.2) A hot-corrosion-resistance-enhancing base sol: Although any sol resulting in an oxide that can enhance the hot-corrosion resistance of the stabilized coatings can be applied, according to this example apply a borosilicate sol. Though the amounts of various ingredients of the sol can vary over a wider range, according to this example, mix them by weight in the following order and amount: Mix by weight in the following order and amount: 32.70 parts MeOH, 2.76 parts orthoboric acid, 1.74 parts aluminum nitrate, 5.12 parts de-ionized water, 0.81 parts lithium nitrate, 33.33 parts tetraethoxysilane. Mix the solution thoroughly. Though there is no time limit for mixing, according to this example, mix the various ingredients of the solution for sixty minutes. To this solution, add 0.09 parts nonionic surfactant, 16.90 parts MEK, and 6.54 parts MeOH and mix the resultant solution thoroughly.

a.2 Diffusion Barrier Sols a.2.1) A stabilized two-phase-glass diffusion barrier sol: In this example, the glass-forming oxides are provided by phosphorous oxide and silicon oxide. The stabilizing agent is provided by the oxides of yttrium and cerium. Additional oxides present are magnesium and aluminum oxides, which should have cationic coordination numbers of 4 in the final oxide. Though the amounts of various ingredients in the sol can vary over a wider range, a preferred embodiments is to mix by weight in the following order and amount: 17.61 parts methyl alcohol (MeOH), 2.60 parts magnesium nitrate, 4.98 parts aluminum nitrate, 15.19 parts tetraethoxysilane, 0.72 parts yttrium nitrate, 0.59 parts cerium nitrate. For homogenization and polymerization, mix the solution thoroughly. Though there is no time limit for mixing, according to this example mix various ingredients of the solution for sixty minutes. To this solution, add a solution which is thoroughly mixed by adding 3.71 parts phosphoric acid, 8.89 parts MeOH. Mix the solution thoroughly. To this solution, add another solution which is thoroughly mixed by adding 0.09 parts non-ionic surfactant, 26.42 parts methyl ethyl ketone (MEK), and 18.42 parts MeOH. Mix the solution thoroughly. Although, the sol is ready for coating, it is preferable to stir the solution for few more hours for better homogenization and polymerization.

a.2.2) An La-stabilized two-phase-glass diffusion barrier sol: In this example, the glass-forming oxides are provided by phosphorous oxide and silicon oxide. The stabilizing agent is provided by the oxides of lanthanum, yttrium and cerium. Additional oxides present are magnesium and aluminum oxides, which should have cationic coordination numbers of 4 in the final oxide. Though the amounts of various ingredients of the sol can vary over a wider range, according to this example mix by weight in the following order and amount: 17.25 parts MeOH, 2.54 parts magnesium nitrate, 4.88 parts aluminum nitrate, 14.88 parts TEOS, 0.70 parts yttrium nitrate, 0.58 parts cerium nitrate and 2.78 parts lanthanum nitrate. Mix the solution thoroughly. Though there is no time limit for mixing, according to this example mix for sixty minutes. To this solution, add a solution of 3.63 parts phosphoric acid and 8.70 parts MeOH that have been thoroughly mixed. To this solution, add a solution of 0.08 parts non-ionic surfactant, 25.90 parts MEK, and 18.05 parts MeOH and mix the resultant solution thoroughly.

a.3) Sealant Layer Sols

Sealant sol: This sol seals the preceding stabilized two-phase-glass diffusion barrier and therefore is referred as sealant sol. Though the amounts of various ingredients of the sol can vary over a wider range, a preferred embodiments is to mix them by weight in the following order and amount: 18.73 parts MeOH, 7.50 parts magnesium nitrate, 2.61 parts aluminum nitrate, 7.83 parts TEOS. For homogenization and polymerization, mix the solution thoroughly. Though there is no time limit for mixing, a preferred embodiments is to mix the various ingredients of the solution for 60 minutes. To this solution, add 7.55 parts phosphoric acid, 9.28 parts MeOH and stir for 60 minutes. Add to the resultant solution, 0.09 parts non-ionic surfactant, 27.85 parts MEK, and 18.56 parts MeOH. Mix the solution thoroughly. Although, the sol is ready for coating, stir the solution for few more hours for better homogenization and polymerization.

b) Applying a Prepared Sol

The sol wets and conforms to the shape of substrate when applied to the substrate. It forms a sol film and adheres to the substrate. Although, the sol can be applied to the substrate by several means such as spraying, brushing, painting, dipping, etc., according to this example, apply by dipping. Although the sol can be applied in ambient air, in dry compressed air or any dry gas, according to this example apply under a nitrogen atmosphere.

Pull the sample from the sol. Although pulling rate of the article can be adjusted in relation to the other parameters such as concentration of the sol, sample size, etc., according to this example, the pulling speed of the article is 7 cm/min for the first layer and 14 cm/min for subsequent layers.

c) Gelling of the Applied Sol

After the substrate is pulled out from the sol, the solvent in the sol film evaporates. As it evaporates, the reactive species in the sol come closer together promoting condensation reactions and the sol gels. A gel is a weak amorphous solid structure containing an interconnected network of fine pores initially filled with liquid. Although the sol can be gelled in ambient air, or any dry gas, according to this example, dry the sol film under a nitrogen atmosphere for 10 minutes to form the gel.

d) Final Drying of the Gelled Sol

Further dry the gelled sol film prior to its conversion into the final oxide. Although drying under ambient conditions will remove residual liquid from the gelled sol, according to this example further dry the gelled sol in an oven at 75° C. for 10 minutes.

e) Curing of the Dried Gel

Curing the dried gel removes most of the remaining volatile constituents, causes further condensation reactions to occur and the gel to cross link and forms the final oxide. Although the dried gel can be cured at any temperature below the melting point of the substrate or coating which ever is less, and for any length of time, a preferred embodiments is to cure the dried gel in a furnace at 650° C. for five minutes.

Test Conditions

Coated and uncoated articles were subjected to the following tests:

1. Isothermal oxidation testing
2. Cyclic oxidation testing
3. Hot corrosion testing in a laboratory furnace
4. Hot corrosion test in a burner rig.

For isothermal testing, articles were placed in a horizontal tube furnaces which were maintained at the test temperature. Testing was interrupted for every 20 hours to record weight change (gain or loss). In thermal cyclic testing, articles were subjected to cyclic oxidization conditions by exposing them to 900° C. for 1 hour and cooling to room temperature and leaving them for 20 minutes in room-temperature air. In hot corrosion testing, 5 mg/cm$^2$ of sodium sulfate were deposited on the articles by spraying. Then the samples were heated to 900° C. in a horizontal tubular furnace in a gas mixture of 0.1% $SO_2$—$O_2$ flowing at 0.1 l/min. At the end of each 24 hours of exposure, the furnace was shut off and the samples were allowed to cool. Then, after rinsing with distilled water to remove the salt deposits, the articles were weighed, the salt deposits replenished, and the articles were returned to the furnace. Burner-rig testing was conducted at 930° C. with an 0.3 Mach velocity flame doped with 5 ppm sodium chloride.

Results of Testing

Figure 2:
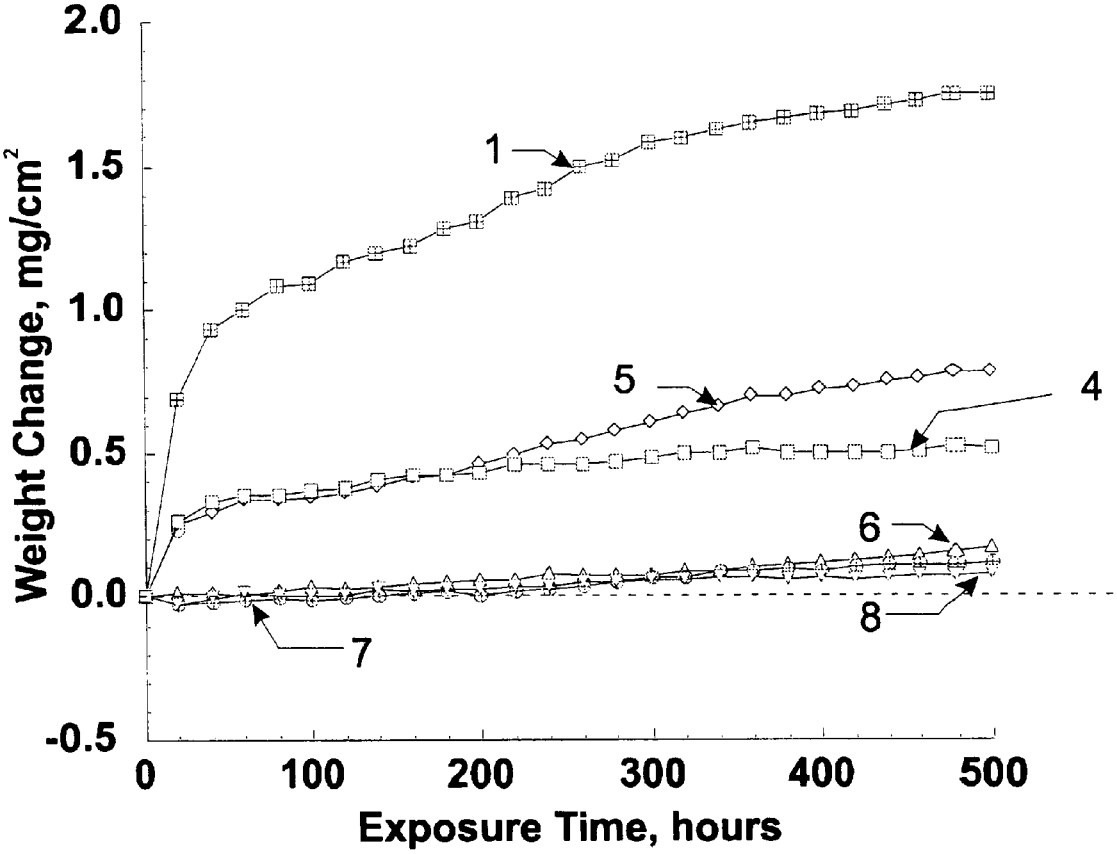
FIG. 2 shows the relative cyclic oxidation resistance of a nickel-based superalloy article (IN 738 LC) at 900° C. before coating, after applying comparable prior-art coatings (platinum-aluminide and nickel-aluminide coatings), after applying the stabilized two-phase-glass diffusion-barrier coating according to this invention over prior-art coatings, and after applying the stabilized two-phase-glass diffusion-barrier coating according to this invention.
Figure 3:
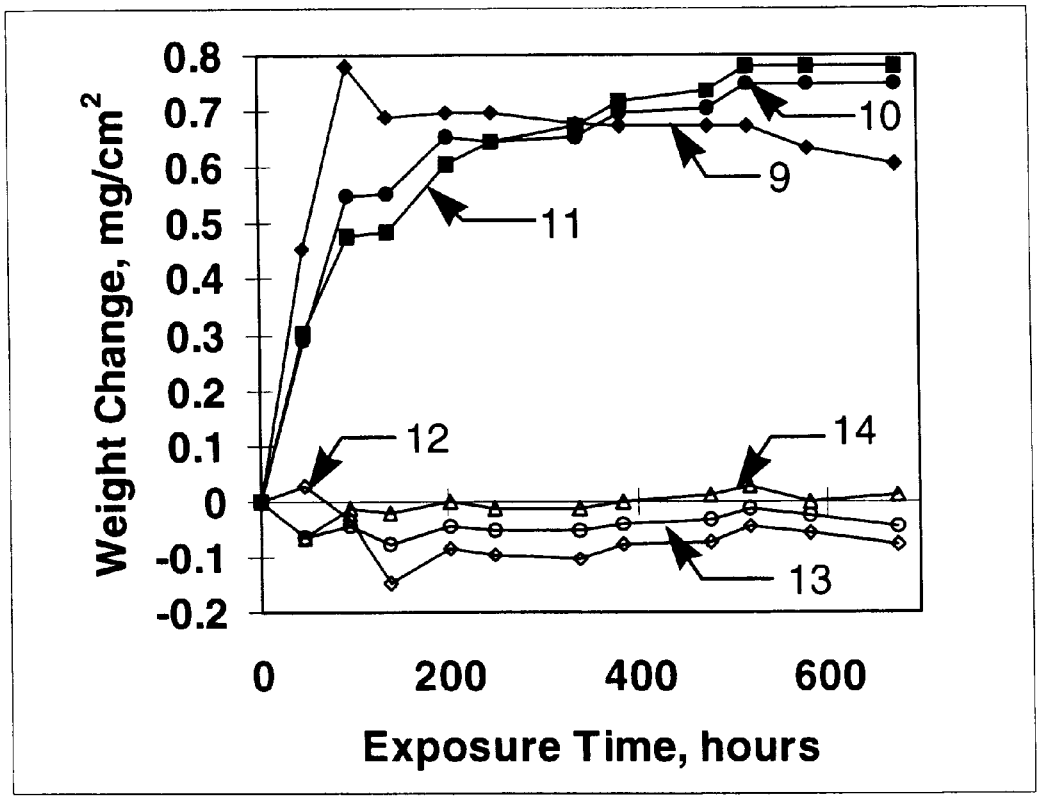
FIG. 3 shows the relative isothermal oxidation resistance of a nickel-based superalloy article (CMSX-4) at 1100° C., before coating, after applying comparable prior-art coatings (platinum-aluminide and nickel-aluminide coatings), after applying an La-stabilized two-phase-glass diffusion barrier coating according to this invention over prior-art coatings, and after applying an La-stabilized two-phase-glass diffusion barrier coating according to this invention.
Figure 4:
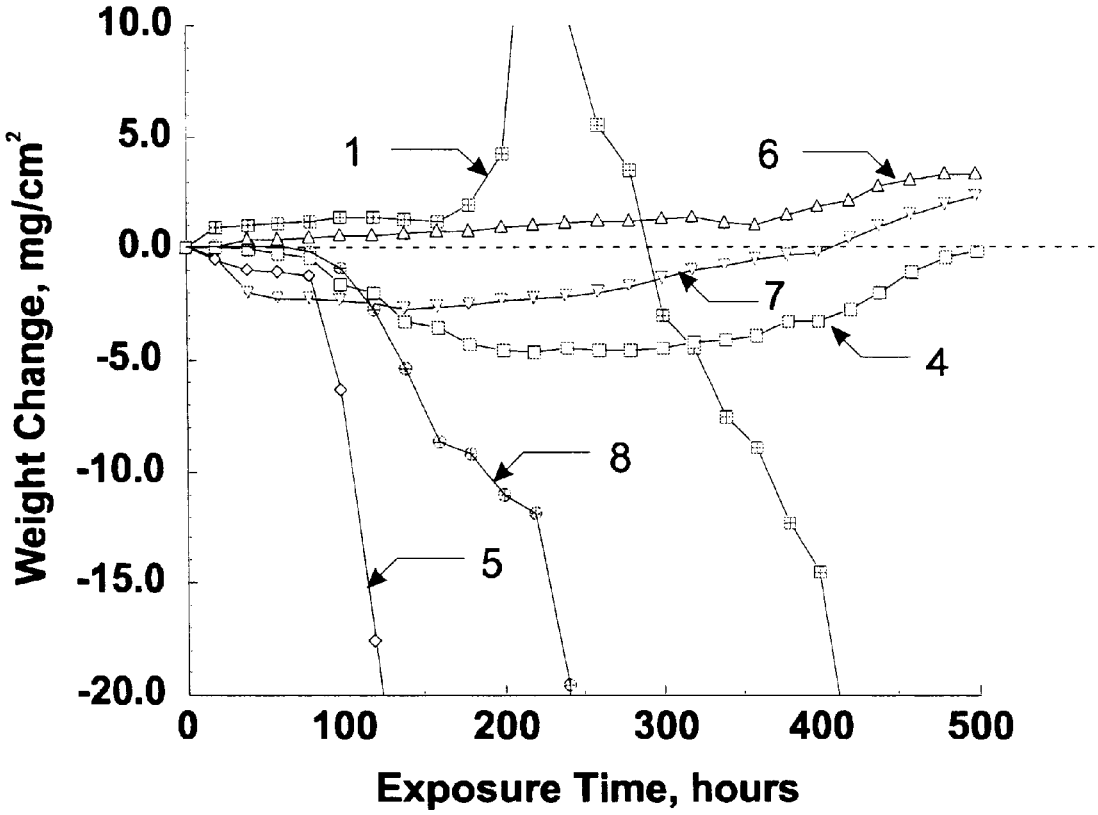
FIG. 4 shows the relative hot-corrosion resistance of a nickel-based superalloy article (IN 738 LC) at 900° C., before coating, after applying comparable prior-art coatings (platinum-aluminide and nickel-aluminide coatings), after applying the stabilized two-phase-glass diffusion-barrier coating according to this invention over prior-art coatings, and after applying the stabilized two-phase-glass diffusion-barrier coating according to this invention.
Figure 5:
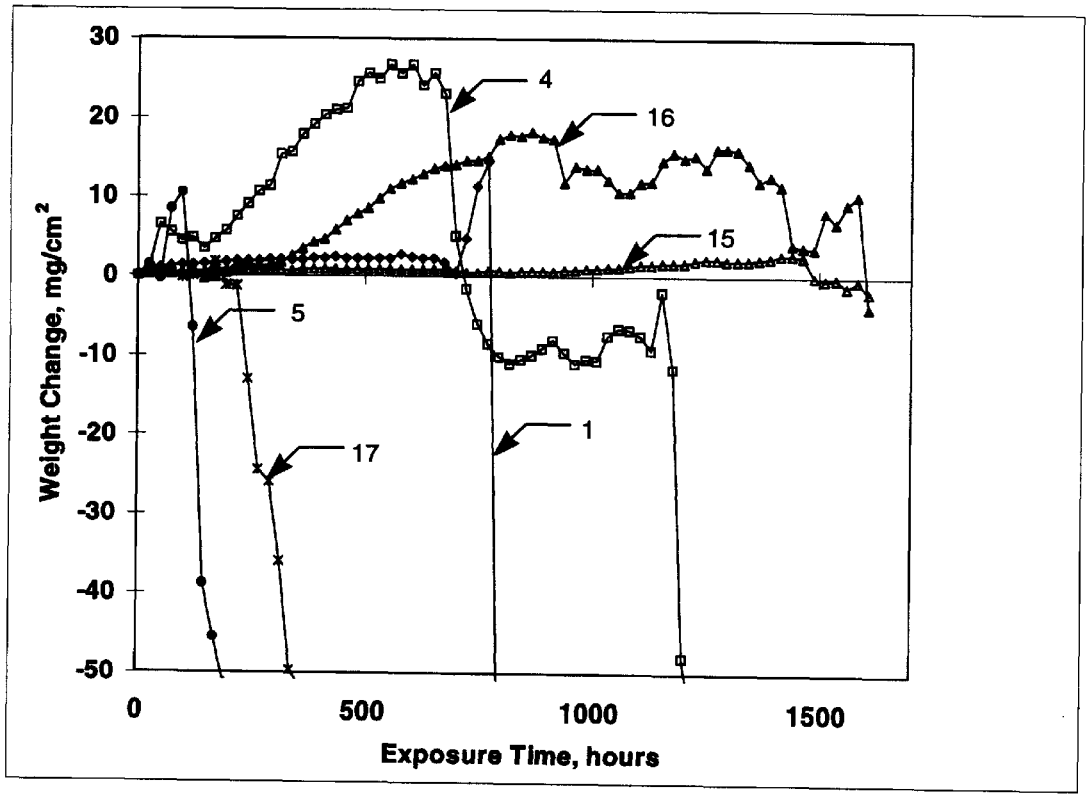
FIG. 5 shows the relative hot-corrosion resistance of a nickel-based superalloy article (IN 738 LC) at 900° C., before coating, after applying comparable prior-art coatings (platinum-aluminide and nickel-aluminide coatings), after applying an La-stabilized two-phase-glass diffusion-barrier coating according to this invention over prior-art coatings, and after applying an La-stabilized two-phase-glass diffusion-barrier coating according to this invention.
Figure 6:
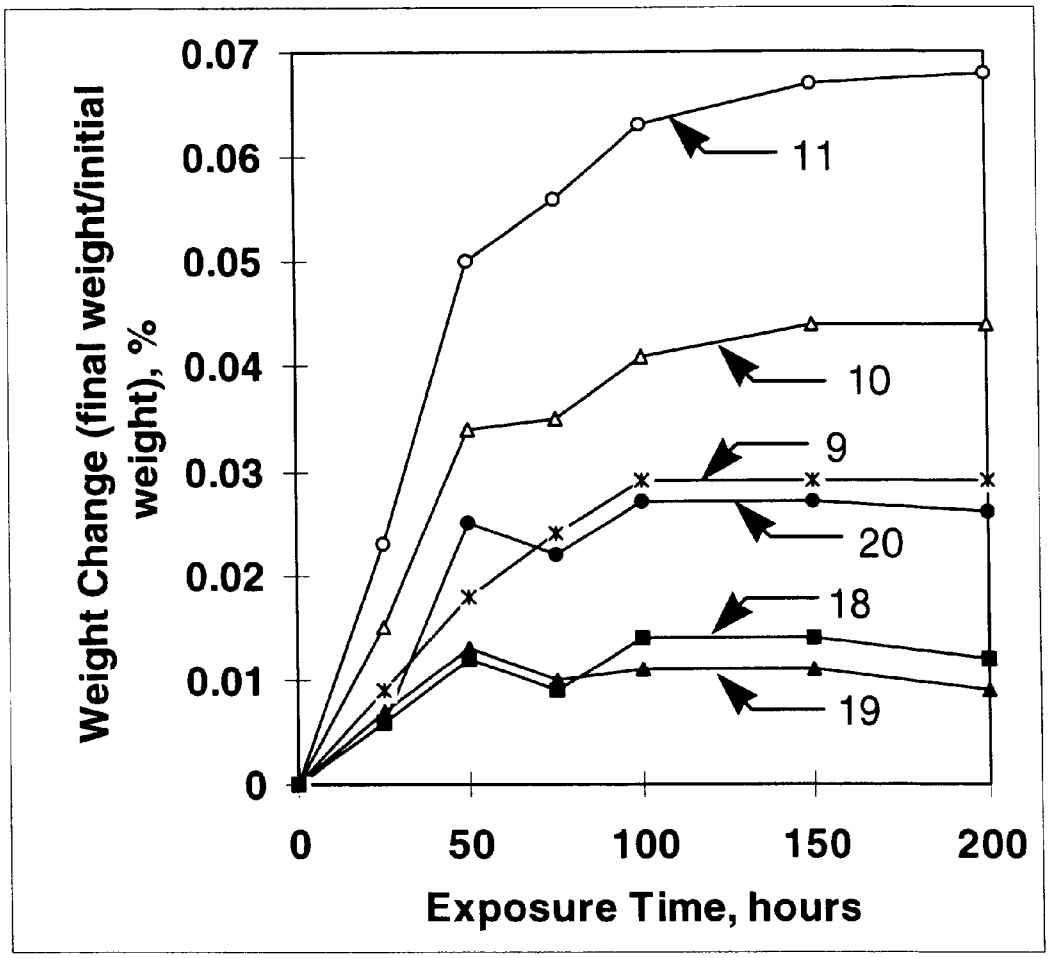
FIG. 6 shows the relative hot-corrosion resistance of a burner-rig tested nickel-based superalloy article (CMSX-4) at 900° C., before coating, after applying comparable prior-art coatings (platinum-aluminide and nickel-aluminide coatings), after applying an La-stabilized two-phase-glass diffusion-barrier coating according to this invention over prior-art coatings, and after applying an La-stabilized two-phase-glass diffusion-barrier according to this invention.

Typical weight change data for articles with different coatings is presented in FIGS. 1–6. Weight gain indicates oxidation, and weight loss indicates volatilization of some portion of the article or spalling. FIGS. 1–3 show typical weight change data for nickel-based superalloys after oxidation and FIGS. 4–6 after hot corrosion. In every test shown, the stabilized two-phase-glass diffusion barrier of this invention showed the least weight change compared to prior-art coated articles and uncoated articles. This is because the stabilized two-phase-glass diffusion barrier of this invention very effectively stops corrosive species from reaching the substrate. In contrast, the prior-art two-phase-glass diffusion barrier was unstable and not adherent to the substrate. The weight change data (FIG. 1) indicated that the prior-art two-phase-glass diffusion barrier spalled within about 50 hours and exposed the substrate resulting in substantial loss of substrate material. Articles coated with prior-art PtAl and NiAl coatings exhibited relatively increased oxidation (FIGS. 2 and 3) and were attacked severely by molten salts that were predominantly sodium sulfate (FIGS. 4 and 5). The stabilized two-phase-glass diffusion barrier of this invention performed effectively under both isothermal and cyclic oxidation conditions. In contrast, prior-art aluminide coatings did worse under cyclic oxidation conditions. The stabilized two-phase glass diffusion barrier resisted hot corrosion under the attack of high-pressure flame deliberately contaminated with chlorides and sulfur (FIG. 6). In addition, the stabilized two-phase-glass diffusion barrier of this invention increased the isothermal oxidation resistance, thermal cyclic durability and hot-corrosion resistance of prior-art-aluminide coatings (FIGS. 2–6).

Therefore, these findings show that the stabilized two-phase-glass diffusion barrier deposited according to this invention resisted oxidation and hot-corrosion better than comparable prior-art coatings by the following mechanisms:

1. It stops corrosive species from reaching and attacking the substrate
2. It is itself corrosion resistant
3. It is contains a stabilize agent that improves its compatibility with the substrate by reducing reactivity and promoting adhesion, and reduces volatility
4. It is composed of oxides that form two or more glassy phases with different softening points, with the lower-softening phase filling cracks, pores and other flaws thereby imparting good durability in thermal cycling.

Further, a process was used that could coat intricate geometries like air passages in turbine blades with ease. This is in contrast to the prior-art coatings that are difficult to apply to such shapes, and instead tend to seal the external openings while leaving the interior uncoated. Another advantage of the process used in this invention is that the substrate materials could be coated and cured at low temperatures or even at room temperature which makes the process economically attractive and safe for most substrate. This is in contrast to the prior-art coatings that used temperatures as high as 1200° C. resulting in increased costs and damaging the mechanical properties of the substrate materials. Further in this invention, a process was used to apply the coating that did not need materials that are costly or materials that are extremely hazardous to man or the environment.

The above examples and embodiments are presented to be typical of, rather than limiting on, the scope of the present invention, as will be appreciated by those skilled in the arts involved and as defined in the appended claims.

Conclusions, Ramifications, and Scope of Invention

Accordingly, the reader will see that coated articles according to this invention resist oxidation and hot corrosion better than comparable articles coated with prior-art coatings because they are composed of oxides with low oxygen diffusivities, and low solubility in the corrosive environment. The stabilized two-phase-glass diffusion barrier material is tailored to have phases for self-healing of the flaws within it. The material is also tough and durable in thermal cycling. Stabilizing agents improve the compatibility of the diffusion barrier with the substrate by reducing reactivity, by promoting adhesion, and by reducing volatility, all of which improve the effectiveness of the diffusion barrier and length of time that the diffusion barrier remains effective. Further, when the stabilized two-phase-glass diffusion barrier is used with other coatings such as prior-art aluminide coatings, it increases their potency by reducing aluminum depletion, by reducing oxygen influx and thereby lowering the necessary critical aluminum concentration for forming external oxide scales, and by shielding the other coatings from corrosive agents to prevent their rapid dissolution in the corrosive environment.

Further, the reader will see that a coating according to this invention can be applied by a process that does not require expensive facilities or equipment, and that the process need not use materials that are extremely hazardous to man and the environment.

Although the above description contains many specificities, these should not be construed as limiting the scope of this invention, but as merely providing illustrations of some of the presently preferred embodiments of this invention. For example, the stabilized two-phase-glass diffusion barrier may:

- contain the oxides of elements other than those listed as the stabilizing agent which improves the compatibility of the coating with the substrate, promotes adhesion and reduces volatility
- be applied in a number of different schemes involving alternating, repeated or multiple layers
- be applied to the substrate by other means such as spraying, brushing, or painting
- be applied by other coating methods such as physical vapor deposition, chemical vapor deposition, etc.
- be thicker or thinner or laminated with other coatings
- be applied to articles experiencing oxidation and hot-corrosion such as gas turbine components: buckets, compressor blades, hydraulic turbines, propellers, vanes, hot-working tools, furnace parts, rollers, rails, baskets, tube-coils in furnaces, steam super heaters, reheater tubing, bolts and nuts, rotors, boilers, fiber industry components, components used in the petroleum industry, or components used in the nuclear industry.

Accordingly, the scope of this invention should be determined by the appended claims and their legal equivalents rather than by examples given.

We claim:

1. A coated article comprising the following:

a) a superalloy substrate;

b) a diffusion barrier layer comprising a layer of stabilized two-phase glass material formed on the substrate, wherein said two-phase glass material comprises a plurality of glass-forming oxides wherein at least two of said glass-forming oxides have field strengths that differ by more than 0.25 to induce a tendency to form multiple glass phases; and c) a layer of sealant material on top of said diffusion barrier, wherein said sealant material comprises a two-phase glass layer that contains more than one glass-forming oxide that induces a tendency to form two or more glass phases.

2. The coated article of claim 1, further comprising a base layer between said substrate and said diffusion barrer that prevents direct contact of the diffusion barrier with said substrate, and improves the adherence of the diffusion barrier and minimizes reactions between the diffusion barrier and the substrate.

3. The coated article of claim 2 wherein said base layer is an alumina layer whereby the performance of the barrier is improved in oxidizing environments.

4. The coated article of claim 2 wherein said base layer is a borosilicate glass whereby the performance of the barrier is improved in hot-corrosion environments.

5. The coated article of claim 1, wherein said layer of sealant material flows to fill cracks, pores, or other flaws in said diffusion barrier.

6. The coated article of claim 1 wherein said substrate is a turbine blade.

* * * * *